US008468769B2

(12) United States Patent
Stanchfield

(10) Patent No.: US 8,468,769 B2
(45) Date of Patent: Jun. 25, 2013

(54) REVERSIBLE DECORATIVE MOLDINGS BETWEEN FLOOR AND WALL OR WALL AND CEILING

(75) Inventor: Oliver O. Stanchfield, Raleigh, NC (US)

(73) Assignee: Pergo (Europe) AB, Trelleborg (SE)

( * ) Notice: Subject to any disclaimer, the term of this patent is extended or adjusted under 35 U.S.C. 154(b) by 1755 days.

(21) Appl. No.: 10/748,852

(22) Filed: Dec. 31, 2003

(65) Prior Publication Data

US 2005/0166526 A1 Aug. 4, 2005

(51) Int. Cl.
*E04B 2/00* (2006.01)
*E04C 2/38* (2006.01)

(52) U.S. Cl.
USPC ..... 52/716.1; 52/717.04; 52/287.1

(58) Field of Classification Search
USPC ..... 52/287.1, 242, 290, 311.1, 136, 716.1–717.06, 312
See application file for complete search history.

(56) References Cited

U.S. PATENT DOCUMENTS

| | | | | |
|---|---|---|---|---|
| 4,557,096 | A * | 12/1985 | Hovde | 52/592.1 |
| 5,444,956 | A * | 8/1995 | Searer et al. | 52/312 |
| 5,711,123 | A * | 1/1998 | Lamont et al. | 52/287.1 |
| 5,819,485 | A * | 10/1998 | Lane et al. | 52/287.1 |
| 6,517,935 | B1 * | 2/2003 | Kornfalt et al. | 428/331 |
| 6,647,681 | B1 * | 11/2003 | Abbott | 52/288.1 |
| 6,910,307 | B1 * | 6/2005 | Maurer | 52/287.1 |
| 2001/0049022 | A1 * | 12/2001 | Takeuchi et al. | 428/423.1 |
| 2002/0018907 | A1 * | 2/2002 | Zehner | 428/537.1 |
| 2003/0159389 | A1 * | 8/2003 | Kornfalt et al. | 52/396.04 |
| 2004/0060251 | A1 * | 4/2004 | Pamplin | 52/311.1 |

FOREIGN PATENT DOCUMENTS

| | | | |
|---|---|---|---|
| GB | 2096665 | A * | 10/1982 |
| GB | 2141457 | A * | 12/1984 |

OTHER PUBLICATIONS

Wood Floor Products: Hardwood Moldings Installation and Maintenance Guide, WoodFloorsOnline.com, Febuary 09, 2002 from the Internet Archive, World View,Inc., 1-11.*

U.S. Publication No. 2007/0125021, published on Jun. 7, 2007 to Thiers et al.

The American Hertiage Dictionary of the English Language, Houghton Mifflin Company, Boston, Massachusetts, p. 734, 1979.

* cited by examiner

*Primary Examiner* — Joshua J Michener
*Assistant Examiner* — Elizabeth A Plummer
(74) *Attorney, Agent, or Firm* — Novak Druce Connolly Bove + Quigg LLP

(57) ABSTRACT

A reversible molding is disclosed having multiple decorative face which differ from one another by at least one property. Such properties can include texture, color, pattern or design or shape. The molding can suitably be used at the joint between a wall and floor or between a wall and ceiling. In one embodiment, the moldings are manufactured from wood, MDF or HDF, with a decorative surface selected from foil, laminate, veneer, paint, stain or digital printing.

26 Claims, 1 Drawing Sheet

REVERSIBLE DECORATIVE MOLDINGS BETWEEN FLOOR AND WALL OR WALL AND CEILING

1. FIELD OF THE INVENTION

The present invention is directed to a decorative molding for use between a floor and wall or between a wall and ceiling. The molding has at least two decorative faces which differ in at least one property. In one embodiment, a single molding has two faces which differ in the design, pattern and/or color carried by each face. The moldings are suitable designed to match or contrast with prefabricated building panels, especially composite panels such as those panels commonly known as laminate panels.

2. BACKGROUND OF THE INVENTION

Laminate building panels have increasingly become more popular as an alternative to conventional building materials. In fact, laminate building panels for use as floor panels, ceiling panels, and wall panels are displacing conventional building materials such as wood, carpet, tile and similar materials in homes, offices and other commercial environments.

When such laminate panels are used as floors, they "float" above a subfloor, i.e., they are not anchored or affixed to the subfloor. This floating permits the laminate panels to expand and contract due to temperature fluctuations. When installing such panels as a floor, it is conventional to leave a small gap between the edge of the floor and the adjacent walls to permit such expansion.

However, the presence of a gap is unsightly and permits dirt, dust, and other debris to lodge in the gap, detracting from the finished look of a newly installed floor.

Accordingly, it has been the practice to use a molding to cover the gap between a floor and an adjacent wall.

However, because there is a wide variety in the colors and/or patterns of laminate panels, providing a molding to match or contrast with such panels requires a large number of moldings having matching or contrasting texture, design, color and/or patterns which requires a supplier of such moldings to maintain a large inventory of moldings.

3. SUMMARY OF THE INVENTION

It is an object of the invention to provide a molding having a plurality of decorative faces wherein each such decorative face has a decorative design, pattern, texture and/or color or shape which differs from at least one other decorative face on the molding.

It is a further object of the invention to provide a flooring system including floor panels with a matching or contrasting molding within a single molding element.

It is a further object of the invention to reduce the inventory of moldings necessary to match or contrast with a laminate or other flooring panels.

It is a still further object of the invention to increase the product use, e.g., from only laminate to laminate and wood, tile, carpet and other products.

These and other objects of the invention will be apparent in connection with reading the detailed description of the further embodiments.

4. BRIEF DESCRIPTION OF THE DRAWINGS

5. DETAILED DESCRIPTION OF THE PREFERRED EMBODIMENTS

Figure 1:
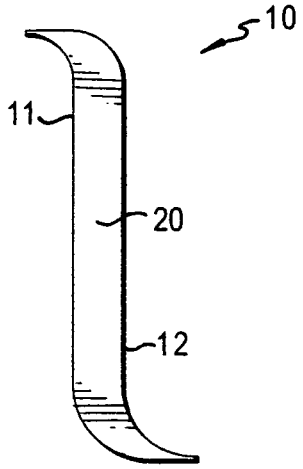
FIG. 1 illustrates a wall base having multiple decorative surfaces according to the invention.

Laminate panels generally comprise a decorative surface and a substrate or core material. As the decorative surface materials such as a plastic, foil, printed decor, paint, stain, protective coatings, veneer or laminate may be used. The surface can be manufactured by gluing a laminate onto the core under heat and pressure (HPL process) or by directly laminating (DL) the layers forming the decorative surface onto the core. As core materials can be mentioned wood based materials such as wood particles adhered with a binder, e.g., particle board, fiberboard (both HDF and MDF); or synthetic materials, such as foam or plastics. Alternatively, it can be natural wood or veneered lumber.

When a printed decor is used as the decorative surface, an overlay of an $\alpha$-cellulose paper, preferably including hard, abrasive resistant particles of silica, alumina, silicon carbide, diamond and particles having a Moh's hardware similar to such materials, can be added to increase the abrasion resistance of the decorative surface. A mixture of larger particles with small particles or various layers of particles can improve the scratch resistance as well as providing abrasion resistance. Typically, such hard particles have an average particle size of 12-90 μm.

While the invention can be employed to make virtually any moldings, such as those between a floor and wall, or between a wall and ceiling, the disclosure of the use of moldings between a floor and wall will facilitate the understanding of the invention.

Typically, a wall base molding is placed at the base of an interior wall to conceal any irregular edges or spaces remaining after the wall has been installed. Wall base also protects the bottom of the wall from damage. Quarter round or base shoe is placed at the juncture between an installed floor and the wall base. The quarter round/base shoe, because it is more flexible than wall base, can cover any irregular spaces between a wall base and the floor. It also covers an irregular edge or spaces where the installed flooring meets the wall base.

Wall Base

Different countries will favor select styles of molding including the molded shape as well as the thickness and height or width of the molding.

Using North America as an example, but not excluding other geographic locations:

The typical wall base can encompass a height of 6 inches or larger or a height of 2½ inches or smaller and the heights between these two examples. Most typically found wall bases are generally, but not exclusively in the range of 3¼ inches, 3½ inches to 4 inches in height. The thickness is generally ½ inch to ¾ inch in thickness and can vary to by design choice, being thicker or thinner.

Quarter Round

The typical quarter round can vary by thickness as well, usually including a thickness of ⅝ inch to ¾ inch, but not limited to these particular measurements.

Base Shoe

The typical base shoe differs from quarter round molding. When installed its' profile is higher than its width, whereas, quarter round molding is usually represented as being a true quarter round so that when it is installed its' height profile is equal to its width. The base shoe can typically be ¾ inch in height and ⅝ inch in width. These measurements can be variable by design choice.

The length of all of the above moldings will vary according to the practices within each geographic location.

The molded shape can vary according to the accepted design found in each geographic area.

The foregoing molding can be made of the same type of materials as are the building panels previously described.

For example, taking the wall base 10 of FIG. 1 as exemplary, the wall base comprises a core 20 of wood based materials, such as solid wood or wood fibers bound together with a binder. Typical of such materials are high density fiberboard (HDF) and medium density fiberboard (MDF).

On either side of core 20 are directly laminated a decorative surface comprising a decor paper impregnated with a liquid thermosetting resin and optionally an overlay paper of α-cellulose, also impregnated with a thermosetting resin. Typical of such thermosetting resins are melamine resins. It is to be understood that opposite faces 11, 12 of wall base 10 differ in at least one property from each other. The property can be texture, color, pattern or design or molded shape.

For example, face 11 can include a printed decor paper while face 12 can be a laminate adhered to core 20 by means of adhesive. The formation of faces 11, 12 can take place simultaneously or sequentially at the factory. The faces can simply be a difference in the color of stain or finish or a solid wood product when core 20 is solid wood or the faces 11, 12 can be formed of foil, laminate, veneer or which can contain digital printing and coated with a liquid. Optionally, the faces can be painted, stained or finished with a clear protective material.

Figure 2:
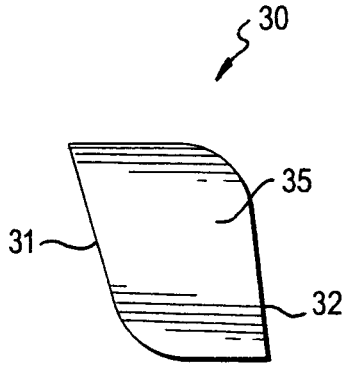
FIG. 2 illustrates a base shoe having reversible decorative surfaces according to the invention.

As shown in FIG. 2, base shoe 30 has a core 35 of MDF or HDF and two decorative faces 31, 32 where face 32 comprises directly laminated layers of decor paper impregnated with thermosetting resin having an overlay of α-cellulose, also impregnated with a thermosetting resin. Optionally, hard particles (not shown) can be included to increase both abrasion and scratch resistance of the base shoe 30. Face 32 can comprise a laminate adhesively attached to core 35.

Typically in North America, Quarter Round and Base shoe moldings are anchored using metal fasteners such as nails-standard finishing nails or wire nails applied with the use of pneumatic tools. Screws may be used as well. Alternative systems using adhesives or tracks or fixtures to "snap" or hang the moldings are also available.

Figure 3:
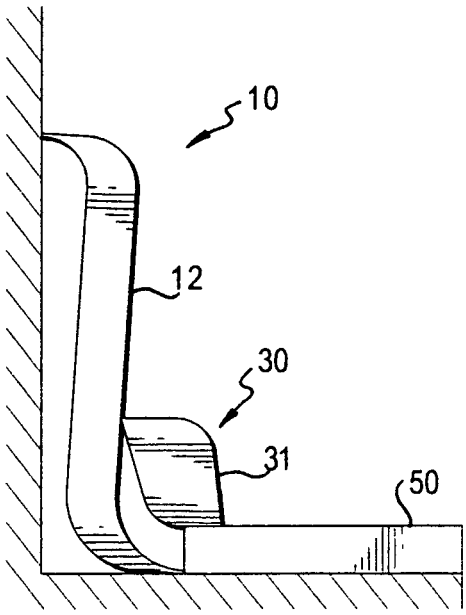
FIG. 3 shows a typical installation of wall base and shoe base moldings against a finished wall and installed floor.

When it is desired to install the base shoe molding 30 against the wall base molding 10 and installed floor 50 as shown in FIG. 3, all that is necessary is to select the desired face 11 or 12 for wall base 10 and desired face 31, 32 of base shoe 30 to contrast or complement/match floor 50 and install as shown.

Figure 4:
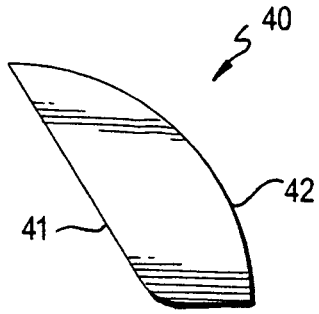
FIG. 4 illustrates a molding according to the invention having two decorative faces of different shape.

FIG. 4 illustrates a single molding 40 according to the invention having faces 41, 42 which differ from each other in shape. As with the other molding, the faces 41, 42 can also differ in other properties from each other, e.g., texture, design, pattern or color.

Although I have described my invention with regard to the joint between a floor and a wall, it will be readily appreciated by those skilled in the art that such disclosure will enable those skilled in the art to employ the invention between a wall and a ceiling or other intersecting surfaces and make other modifications without departing from the spirit and scope of the invention.

I claim:

1. A wood-based reversible molding comprising a wood-based core, said core being shaped as a wall base molding, a shoe molding, or a quarter round molding; said shaped core having a plurality of decorative faces affixed to said shaped core wherein at least two of said faces differ in at least one property selected from the group consisting of texture, design, pattern, and color, wherein said faces have the same shape and each of said decorative faces is independently selected from the group consisting of foil, laminate, veneer, paint, stain, and clear protective material, with the proviso that the orientation of the core against a wall will expose at least one, but not two, of said faces, wherein at least one decorative face comprises a printed decor paper and an overlay of α-cellulose.

2. The reversible molding of claim 1, wherein the molding comprises a wood product selected from the group consisting of particle board, MDF, HDF and veneered lumber.

3. The reversible molding of claim 1, wherein the decorative faces comprise a curved surface.

4. The wood-based reversible molding of claim 1, wherein at least one decorative face comprises laminate.

5. The wood-based reversible molding of claim 1, wherein each of said faces is in the shape of a wall base molding.

6. The wood-based reversible molding of claim 1, wherein each of said faces is in the form of base shoe.

7. The combination of a floor and wall joint with the wood-based reversible molding of claim 1.

8. The combination of a laminate floor and wall joint with the wood-based reversible molding of claim 1.

9. The combination of at least one laminate wall panel in combination with the wood-based reversible molding of claim 1.

10. The wood-based reversible molding of claim 1, wherein the wood-based core comprises a material selected from the group consisting of natural wood and veneered lumber.

11. The wood-based reversible molding of claim 1, wherein each of said faces is in the form of a quarter round.

12. The wood-based reversible molding of claim 1, wherein each of said faces differs from each other of said faces.

13. A wood-based reversible wall base, shoe, or quarter round molding comprising a wood-based core having a plurality of decorative faces affixed to said core wherein at least two of said faces differ in shape and at least one property selected from the group consisting of texture, design, pattern, and color, and each of said faces independently comprise at least one selected from the group consisting of foil, paint, clear protective material, stain, laminate, and veneer, with the proviso that the orientation of the core against a wall will expose at least one, but not two, of said faces.

14. The wood-based reversible molding of claim 13, wherein the reversible molding comprises a core comprising one selected from the group consisting of particle board, MDF and HDF upon which the decorative faces are affixed.

15. The wood-based reversible wall base, shoe or quarter round molding of claim 13, wherein at least one of said faces comprises a foil.

16. The reversible molding of claim 13, wherein at least one of said faces is in the form of at least one molding selected from the group consisting of a quarter round and base shoe.

17. The reversible molding of claim 16, wherein at least a second one of said faces is in the form of at least one molding selected from the group consisting of a quarter round and base shoe.

18. The wood-based reversible molding of claim 13, wherein the core comprises a material selected from the group consisting of natural wood and veneered lumber.

19. The wood-based reversible molding of claim 13, wherein at least one of the decorative faces comprises a curved surface.

20. The wood-based reversible molding of claim 13, wherein each of said faces differs from each other of said faces.

21. A method of reducing molding inventories comprising:

offering a wall base, shoe or quarter round molding to a purchaser of wall base, shoe or quarter round molding inventories, said wall base, shoe or quarter round molding comprising a plurality of decorative faces affixed to a wood-based core of the wall base, shoe or quarter round molding such that rotation of the wood-based core will expose at least one of the decorative faces wherein at least two of said faces differ in at least one property selected from the group consisting of texture, design, pattern, color and shape, and each of said faces independently comprise at least one selected from the group consisting of foil, laminate, veneer and clear protective material; and selling said wall base, shoe or quarter round molding to said purchaser.

22. The wood-based reversible molding of claim 13, wherein each of said faces comprises a foil.

23. The wood-based reversible molding of claim 13, wherein at least one of said faces is in the shape of a wall base molding.

24. The method of claim 21, wherein the core comprises a material selected from the group consisting of natural wood and veneered lumber.

25. The method of claim 21, wherein at least one of the plurality of decorative surfaces comprises a curved surface.

26. The method of claim 21, wherein each of said faces differs from each other of said faces.

* * * * *